US007832059B2

(12) United States Patent
Landmesser

(10) Patent No.: US 7,832,059 B2
(45) Date of Patent: Nov. 16, 2010

(54) DEVICE ON A SPINNING PREPARATION MACHINE, FOR EXAMPLE A DRAW FRAME, CARDING MACHINE, COMBING MACHINE OR THE LIKE, HAVING A DRAFTING SYSTEM

(75) Inventor: Thomas Landmesser, Erkelenz (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 213 days.

(21) Appl. No.: 12/076,919

(22) Filed: Mar. 25, 2008

(65) Prior Publication Data

US 2008/0263831 A1 Oct. 30, 2008

(30) Foreign Application Priority Data

Apr. 27, 2007 (DE) ..... 10 2007 020 448

(51) Int. Cl.
*D01H 5/00* (2006.01)

(52) U.S. Cl. ..... 19/236

(58) Field of Classification Search ..... 19/65 A, 19/236

See application file for complete search history.

(56) References Cited

U.S. PATENT DOCUMENTS

| | | | | |
|---|---|---|---|---|
| 5,313,689 | A | 5/1994 | Oexler | |
| 2002/0061134 | A1 | 5/2002 | Cofer et al. | |
| 2004/0006886 | A1* | 1/2004 | Lee et al. | 34/82 |
| 2005/0168720 | A1* | 8/2005 | Yamashita et al. | 356/4.01 |
| 2007/0137489 | A1* | 6/2007 | Luo | 96/224 |
| 2008/0021597 | A1 | 1/2008 | Merte et al. | |
| 2008/0022550 | A1* | 1/2008 | Masters | 34/480 |

FOREIGN PATENT DOCUMENTS

| | | | |
|---|---|---|---|
| DE | 10 2004 041 821 | A1 | 3/2006 |
| DE | 10 2004 048 563 | A1 | 4/2006 |
| GB | 725466 | | 4/1953 |
| GB | 805341 | | 11/1954 |
| GB | 1 398 995 | A | 8/1972 |
| WO | WO 91/05893 | | 5/1991 |
| WO | WO 2007/085330 | A1 | 8/2007 |

OTHER PUBLICATIONS

UK Intellectual Property Office Search Report, dated Jul. 10, 2008, issued in connection with counterpart British Application No. GB0807510.3.

UK Intellectual Property Office Search Report, dated Jun. 12, 2008, issued in connection with counterpart British Application No. GB0805126.0.

* cited by examiner

*Primary Examiner*—Shaun R Hurley
(74) *Attorney, Agent, or Firm*—Venable LLP; Robert Kinberg; Ryan M. Flandro

(57) ABSTRACT

In a device on a spinning preparation machine, having a drafting system for drawing at least one fibre silver with drafting system rollers, forming drafting roller pairs, having power transmission means for driving the drafting system rollers and having a drive motor, the drive of the drafting system rollers is effected from different sides. In order to reduce the number of drive elements and to effect a substantial improvement in efficiency, the drive motor has two rotating drive elements, the drive of at least one roller pair being effected from one side by the first drive element and the drive of at least one other roller pair being effected from the other side by the second drive element.

22 Claims, 5 Drawing Sheets

DEVICE ON A SPINNING PREPARATION MACHINE, FOR EXAMPLE A DRAW FRAME, CARDING MACHINE, COMBING MACHINE OR THE LIKE, HAVING A DRAFTING SYSTEM

CROSS REFERENCE TO RELATED APPLICATION

This application claims priority from German Patent Application No. 10 2007 020 448.7 dated Apr. 27, 2007, the entire disclosure of which is incorporated herein by reference.

BACKGROUND OF THE INVENTION

The invention relates to a device on a spinning preparation machine, for example a draw frame, carding machine, combing machine or the like, having a drafting system for drafting at least one fibre sliver. Typically, a drafting system has drafting system rollers forming drafting roller pairs, having power transmission means for driving the drafting system rollers and having a drive motor, the drive of the drafting system rollers being effected from different sides.

In a known device (WO 91/05893 A, corresponding to U.S. Pat. No. 5,313,689; referring to FIG. 1), the drive pulleys 2, which are driven by a motor 1, are connected to a main drive shaft 40 by means of a flat belt 20 and drive pulleys 3. The rotations for the drafting system rollers 30, 31, 32 are derived from the main drive shaft 40 by way of drive pulleys 4 and 10. The drive pulley 4 is for drive purposes connected to an intermediate drive shaft 41 by means of a belt 22 and a drive pulley 5. The drafting system roller 30 is driven by the intermediate drive shaft 41 by way of drive pulleys 6 and 7 which are connected by a belt 23. By virtue of the arrangement of the drive pulleys 4, 5, 6 and 7, which have different diameters, a suitable rotational movement is to be applied to the drafting system roller 30 in dependence upon the fibre sliver to be drafted and the draft to be applied to the fibre sliver. The drafting system rollers 30, 31 effecting preliminary drafting of the fibre sliver are for drive purposes connected by means of a flat belt 24. By selection of a suitable diameter for the drive pulleys 8 and 9 it is possible to achieve a rotational speed ratio of the drafting system rollers 30, 31 relative to one another which determines the extent of the preliminary drafting of the fibre sliver. The rotational movement of the drafting system roller 32 is obtained from the main drive shaft 40 by means of the drive pulley 10 and from a flat belt 21 by means of a drive pulley 12. The drafting system roller 32 effects the main drafting of the fibre sliver. The gearing layout is expensive in terms of apparatus. The drive means has several branches and has a large number of drive elements. A particular problem is that several transmission steps are necessary, which results in gear losses and accordingly in addition reduces the efficiency of the drive means.

SUMMARY OF THE INVENTION

It is an aim of the invention to provide a device of the kind described at the beginning which avoids or mitigates the mentioned disadvantages, which, in particular, involves use of a relatively small number of drive components and the efficiency of which is substantially improved.

The invention provides an apparatus on a drafting system of a spinning preparation machine with drafting system rollers forming drafting roller pairs, having a drive motor and transmission devices for driving the drafting system rollers, wherein the drive motor has first and second rotating drive elements, and the arrangement is such that the drive of at least a first roller pair is effected from one side by the first drive element and the drive of at least one further roller pair is effected from the other side by the second drive element.

According to the invention, the number of elements of the drive means of the drafting system rollers can be reduced so that a considerable economic advantage is obtained. The drive elements are so arranged relative to one another that there are almost no branches, so that mechanical losses are avoided. A particular advantage is obtained because the driving power of the motor can be conducted to the drafting system rollers directly or via only one gear. As a result, it is possible to achieve high performance at high rotational speed and accordingly to effect a substantial improvement in the efficiency of the drive means.

Advantageously, the drive elements are rotatable elements extending from opposed sides of the drive motor. For example, the drive elements may be outgoing shaft ends of the drive motor. Advantageously, drive pulleys are mounted on the shaft ends.

In another, advantageous embodiment, the drive elements may be rotating outer wall faces of the drive motor.

The apparatus may, in certain embodiments, include one or more drive trains. Advantageously, there is a gear at least in one drive train. Advantageously, the gear is arranged between the drive motor and at least one driven roller pair. Advantageously, a mechanical gear is present. Advantageously, the gear has a transmission stage. Preferably, the gear is driven by the drive motor.

The apparatus may include any suitable transmission arrangement or arrangements. By way of example, the drive of the drafting rollers and/or of the gear may be effected by way of belts, for example, one or more belts selected from flat belts and toothed belts. Advantageously, the belts are associated with belt-tensioning pulleys.

In certain preferred embodiments, there is a plurality of drive pulleys for driving machine elements, especially drafting system rollers. Advantageously, there is at least one transmission element, especially a belt, in each case passing around at least two drive pulleys. It is preferred that the drive pulleys, or at least some of the drive pulleys, have different diameters.

Advantageously, the drive of the output roller pair of the drafting system is effected by the first drive element. It is further advantageous in that case that the drive of the input and middle roller pairs of the drafting system is effected by the second drive element. Advantageously, the driving drive pulley of the first drive element has a larger diameter than the driven drive pulley for the output roller pair. Advantageously, the driving drive pulley of the second drive element has a smaller diameter than the driven drive pulley at the input of the gear. Advantageously, the driving drive pulley at the output of the gear has a smaller diameter than the driven drive pulleys for the input and middle roller pairs. Advantageously, the driving drive pulley of the second drive element and the driven drive pulley at the input of the gear are constructed as stepped pulleys. Advantageously, drafting system rollers forming preliminary drafting and main drafting roller pairs are present. If desired, a said drive element may be used to drive one or more machine components in addition to one or more drafting roller pairs. For example, the drive of the calender rollers may be derived from the first drive element and/or the drive of the rotary plate may be derived from the first drive element.

The apparatus may be used in a variety of drawing systems. It is preferred that, at the output, a lower roller co-operates with two upper rollers.

In one variant of the invention, the input roller pair has a driven drive pulley on one side and a driving drive pulley on the other side and the driving drive pulley is used for driving the middle roller pair.

In a further embodiment of the invention, the middle roller pair has a driven drive pulley on one side and a driving drive pulley on the other side and the driving drive pulley is used for driving the input roller pair.

It is preferred that the belt for driving the input and middle roller pairs is associated with at least one guide pulley and/or with at least one tensioning pulley.

The invention also provides an apparatus on a spinning preparation machine, for example a draw frame, carding machine, combing machine or the like, having a drafting system for drafting at least one fibre sliver with drafting system rollers forming drafting roller pairs, having power transmission means for driving the drafting system rollers and having a drive motor, the drive of the drafting system rollers being effected from different sides, wherein the drive motor has two rotating drive elements, the drive of at least one roller pair being effected from one side by the first drive element and the drive of at least one other roller pair being effected from the other side by the second drive element.

Certain illustrative embodiments of the invention are described in greater detail below with reference to the accompanying drawings, in which:

A BRIEF DESCRIPTION OF THE DRAWINGS

FIG. 1*a* is a diagrammatic plan view of the gearing layout of a draw frame having a first embodiment of the drive according to the invention;

FIG. 1*b* is a first side view of the drive apparatus according to FIG. 1*a;*

FIG. 1*c* is a second side view of the drive apparatus according to FIG. 1*a*, from the side opposed to that of FIG. 1*b;*

DETAILED DESCRIPTION OF CERTAIN PREFERRED EMBODIMENTS

Figure 5:
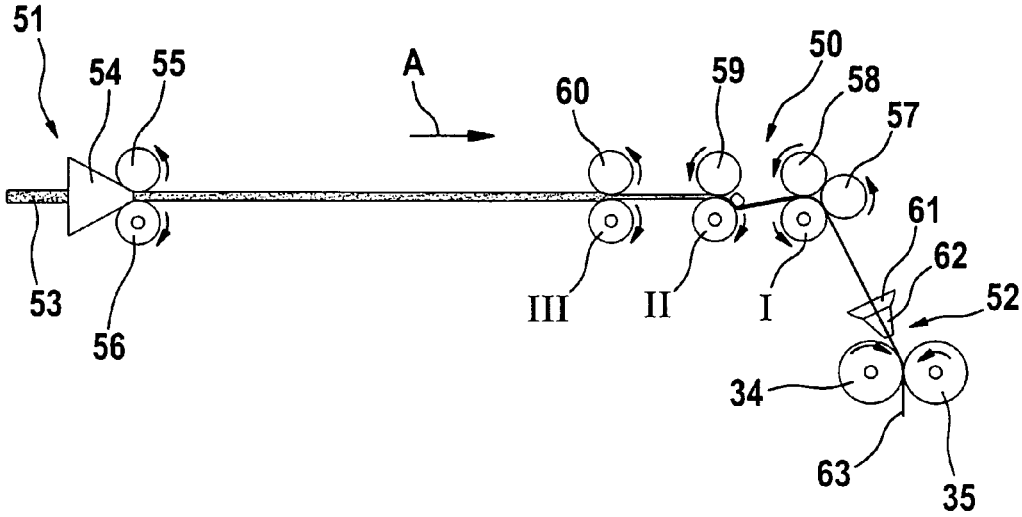
FIG. 5 is a diagrammatic side view of a 4 over 3 drafting system having four upper rollers and three lower rollers.

In the first embodiment of the invention, the gearing layout of a drafting system for a draw frame, for example a draw frame known as TD 02 draw frame made by Trützschler GmbH & Co. KG of Mönchengladbach, Germany, may be arranged according to FIG. 1*a* to 1*c*. An electric drive motor 1 is connected to the drafting system lower rollers I, II, III. In particular, the drafting system lower rollers I, II, III are driven by toothed belts. Rotation of the drafting system upper rollers (which may be arranged, for example, as shown in FIG. 5), is effected as a result of the contact pressure of the upper rollers on the lower rollers.

The motor 1 has a rotating drive shaft which, projecting beyond the two end faces, forms two shaft journals 2*a*, 2*b* (shaft ends). Driving drive pulleys 3 and 4 are mounted on the journals 2*a* and 2*b*, respectively, so as to rotate therewith. The shaft journal 2*a* and the drive pulley 3 form a first drive element 5 and the shaft journal 2*b* and the drive pulley 4 form a second drive element 6.

The drive pulley 3 driven by the motor 1 is connected to the driven drive pulley 8 of a gear 10 by means of an endlessly circulating toothed belt 7. The gear 10 has, in addition, a driving drive pulley 9 which is arranged coaxially to the driven drive pulley 8. Driven drive pulleys 14 and 15 are mounted on the journals 11 and 12 (i.e. the drive shafts) of the lower rollers III and II, respectively, so as to rotate therewith. The driving drive pulley 9 of the gear 10 is connected to the driven drive pulleys 14 and 15 by means of an endlessly circulating toothed belt 16 which passes around them. Reference letter A denotes the working direction.

The following have proved advantageous: rotational speed of shaft journals 2*a*, 2*b* e.g. 3000

$$\frac{1}{\text{min}},$$

drive pulley 3 diameter from 65 to 75 mm, diameter of drive pulley 8 from 115 to 125 mm, diameter of drive pulley 9 from 40 to 50 mm, rotational speed of drive pulleys 8 and 9 from 1500 to 2000

$$\frac{1}{\text{min}},$$

drive pulley 14 (diameter from 40 to 50 mm, rotational speed from 1500 to 2000

$$\frac{1}{\text{min}}),$$

drive pulley 15 (diameter from 25 to 35 mm, rotational speed from 2400 to 2600

$$\frac{1}{\text{min}}).$$

In that way, the drive of the input roller pair and the middle roller pair (see FIG. 5) is effected from one side of the motor 1 by the first drive element 5.

A driven drive pulley 17 is mounted on the journal 13 (or a drive shaft) of the lower roller I so as to rotate therewith. The drive pulley 4, which is driven by the motor 1, is connected to the driven drive pulley 17 by means of an endlessly circulating toothed belt 18 which passes around them.

The following have proved advantageous: drive pulley 4 diameter from 130 to 150 mm, drive pulley 17 diameter from 40 to 50 mm, rotational speed of drive pulley 17 from 9000 to 9600

$$\frac{1}{\text{min}}.$$

In that way, the drive of the output rollers (see FIG. 5) is effected from the other side of the motor 1 by the second drive element 6.

Figure 2:
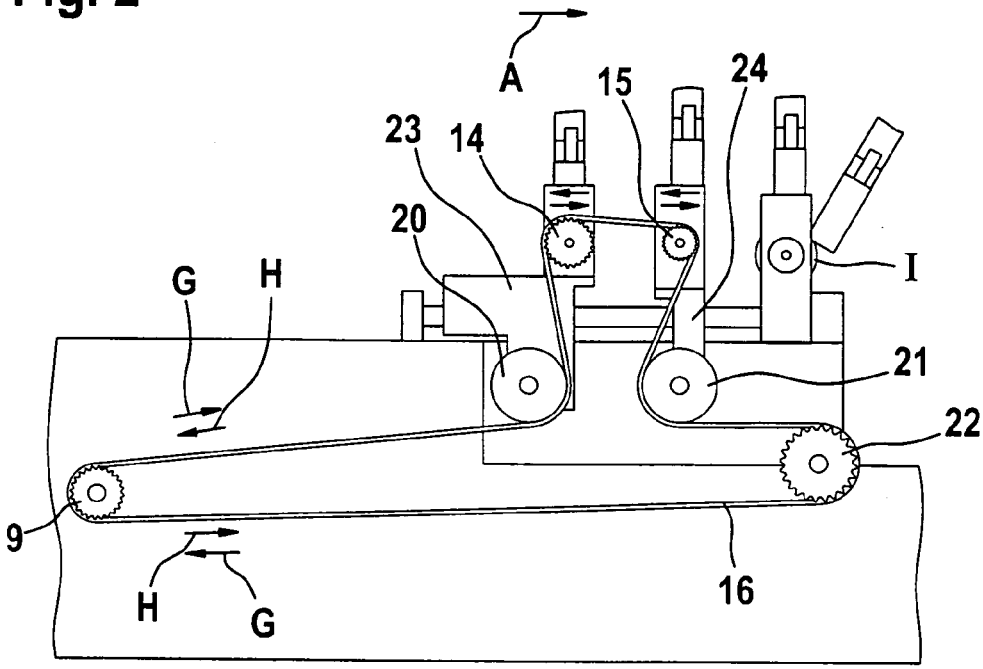
FIG. 2 is a side view of a drive apparatus according to a second embodiment of the invention, having displaceable bearings of the input and middle lower rollers with two guide pulleys.

In the embodiment of FIG. 2, the lower rollers II and III are driven from the left, seen in the opposite direction to the direction of material flow A, by way of a common encompassing drive means in the form of toothed belt pulleys 14, 15 and a toothed belt 16. The different rotational speeds of the lower rollers II and III are implemented by change wheels on the drive journals 11, 12 having different numbers of teeth. In operation, that is to say when the fibre slivers are running in direction A, the toothed belt 16 moves in direction G. Starting from the toothed belt pulley 9, the toothed belt 16 passes in succession over a smooth guide pulley 20, the toothed belt pulley 14 (roller drive pulley of lower roller III), the toothed belt pulley 15 (roller drive pulley of lower roller II), a smooth guide pulley 21 and a toothed belt pulley 22. The toothed belt 16 is, by way of its teeth, in interlocking engagement with the toothed belt pulleys 14, 15, 22 and 9. The plain side (rear side)—the other side from the toothed side—of the toothed belt 16 is in contact or in engagement with the smooth guide pulleys 20, 21. The toothed belt 16 passes around all pulleys. In operation (fibre slivers run in direction A during the drafting), the toothed belt pulleys 14, 15, 22, 9 rotate clockwise and the guide pulleys 20, 21 anti-clockwise. If the nip line spacing between the input and middle roller pairs is to be changed (increased or decreased), the carriage(s) 23 and/or 24 can be displaced.

Figure 1A:
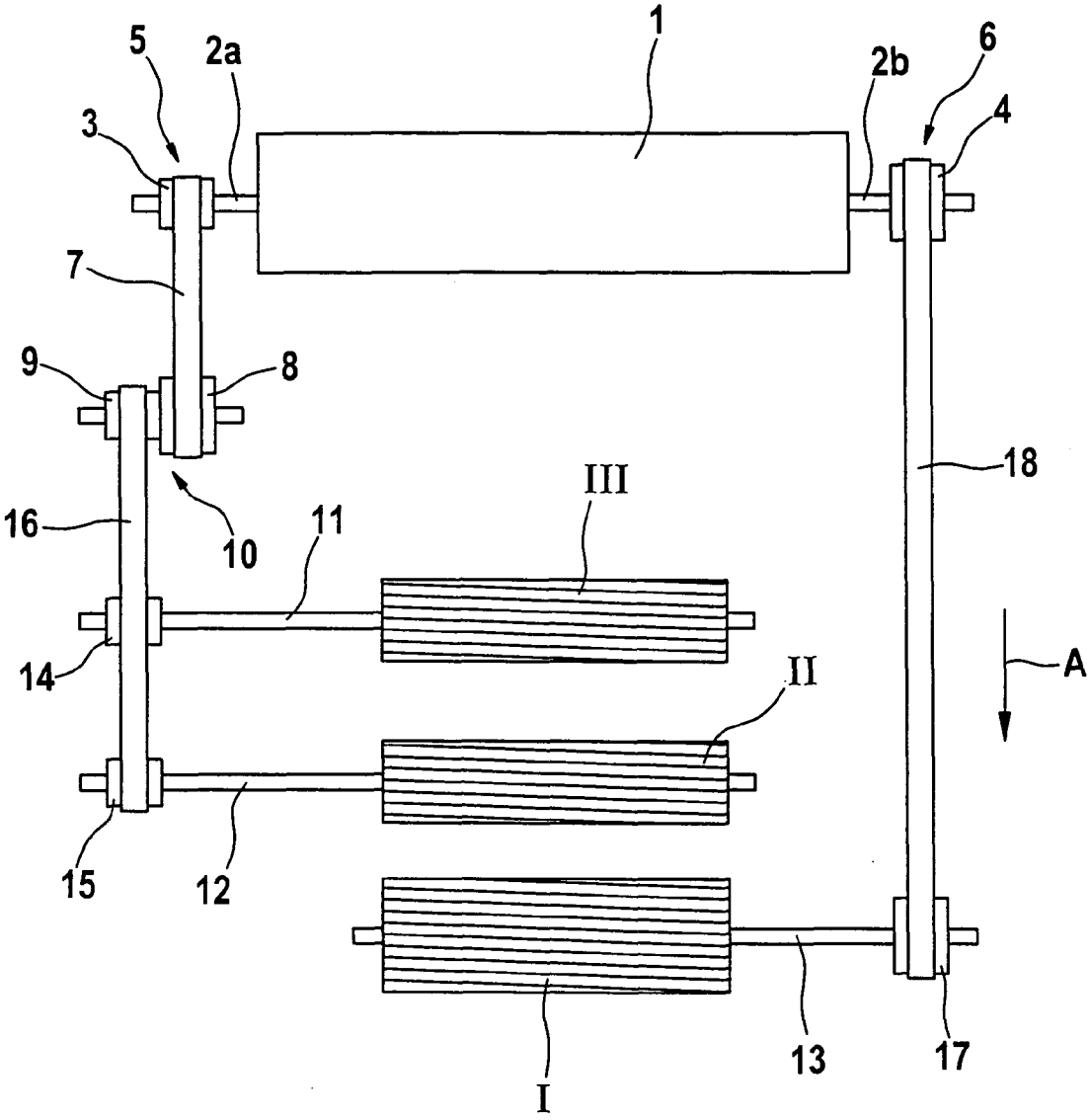
Figure 1B:
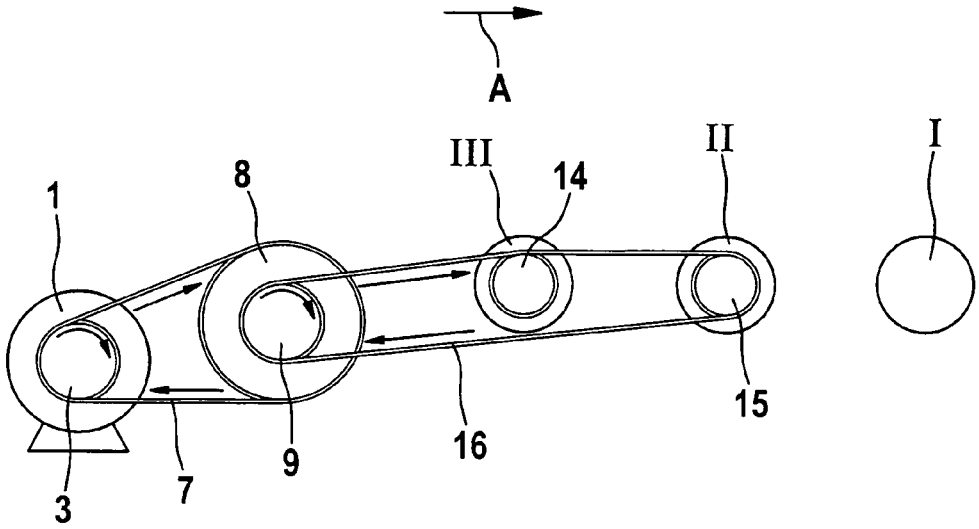
Figure 1C:
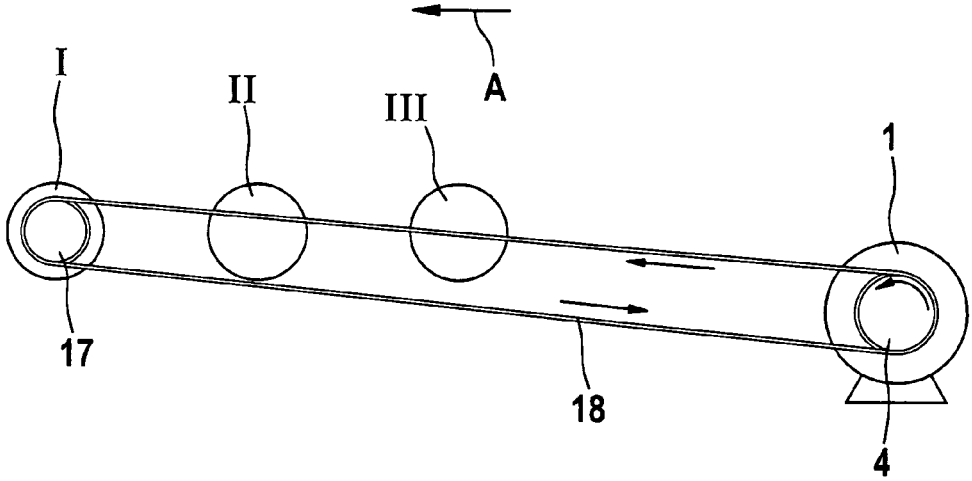
Figure 3:
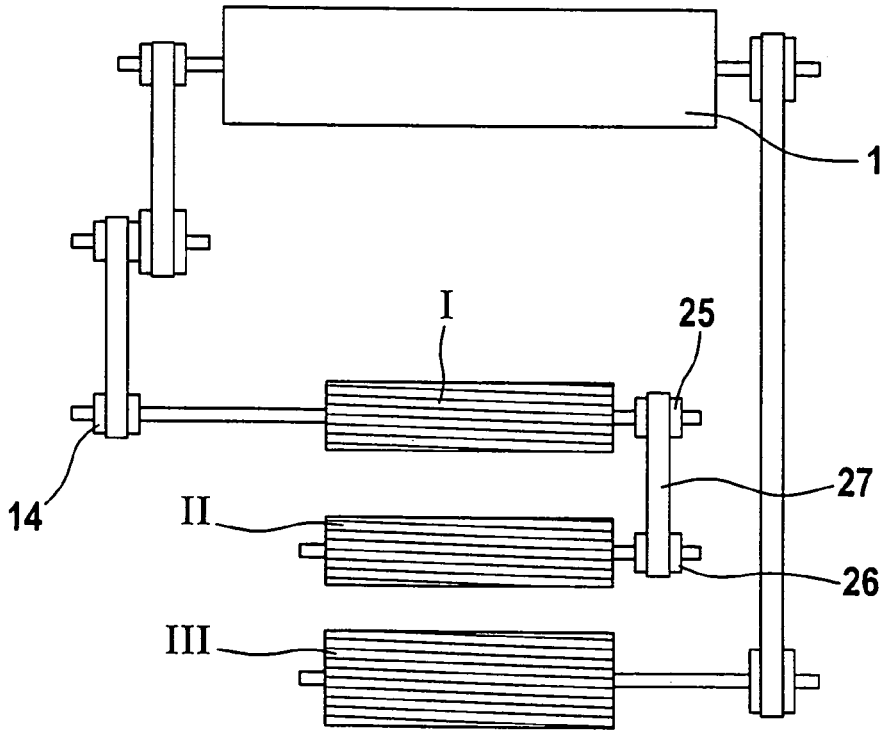
FIG. 3 is a plan view of a third embodiment configured generally as in FIG. 1*a*, but with the drive of the intake lower roller and the drive of the middle lower roller effected from different sides of those rollers.

In the embodiment of FIG. 3, the configuration is generally similar to that of FIG. 1*a*. In contrast, to the arrangement of FIG. 1*a*, however, the driven drive pulley 14 is mounted on one side of the input lower roller I and a driving drive pulley 25 is mounted on the other side. Also on the other side, the middle lower roller II is associated with a driven drive pulley 26. The drive pulley 25 is connected to the drive pulley 26 by means of a toothed belt 27. As a result, the drive of the input and middle lower rollers is effected from different sides of those rollers. The drive for the lower output roller III of FIG. 4 (which corresponds to lower output roller I of FIGS. 1*a* and 5), is as described with respect to lower output roller I of FIG. 1*a*.

Figure 4:
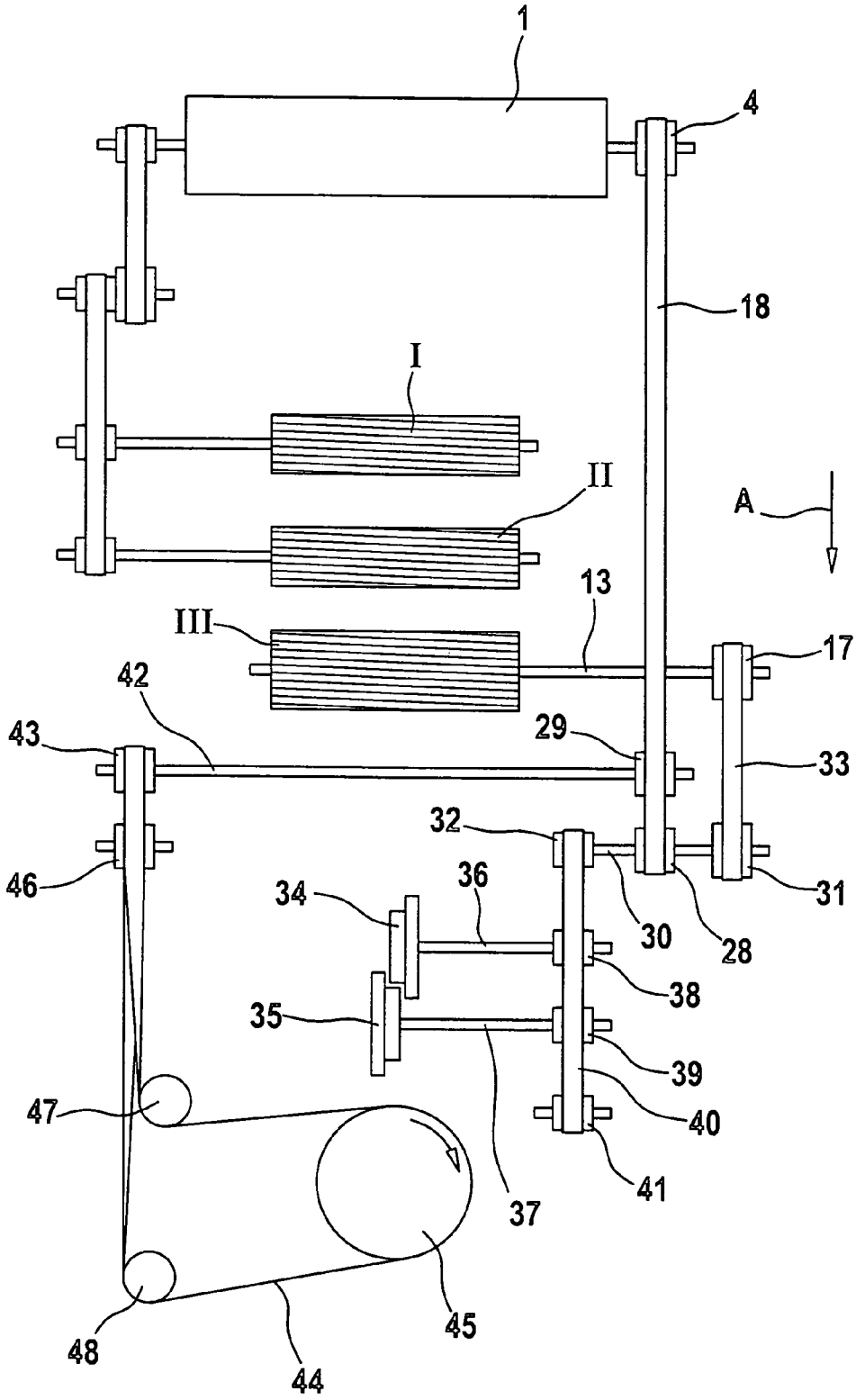
FIG. 4 is a gearing layout similar to that of FIG. 1*a*, but with a common drive arrangement for the output lower roller, the delivery rollers and drive means for the coiler plate.

FIG. 4 shows an embodiment, similar in some respects to FIG. 1*a*, in which the driving drive pulley 4 drives a driven drive pulley 28 and a driven drive pulley 29. The drive pulley 28 is mounted on a drive shaft 30 on which there are coaxially arranged a driving drive pulley 31 and a driving drive pulley 32. The driving drive pulley 31 is connected to the driven drive pulley 17 for the lower output roller III by means of a toothed belt 33.

The delivery rollers 34 and 35 are connected coaxially to driven drive pulleys 38 and 39 by way of shafts 36 and 37, respectively. A toothed belt 40 passes around the drive pulleys 32, 38, 39 and a further drive pulley 41.

The drive pulley 29 is connected coaxially to a drive pulley 43 by way of a shaft 42. The drive pulley 43 drives the coiler plate 45 for the drafted fibre sliver by way of a toothed belt 44, the toothed belt 44 being in engagement with a tensioning pulley 46 by way of two guide pulleys 47, 48.

The drive for input and middle lower rollers I and II is as shown in FIG. 1*a*.

FIG. 5 shows one form of drafting system that may suitably incorporate a drive apparatus according to the invention. Upstream of the drafting system 50 there is arranged a drafting system inlet 51 and downstream there is arranged a drafting system outlet 52. The fibre slivers 53, coming from cans (not shown) or from can-less fibre sliver packages, enter a sliver guide means 54, are withdrawn by delivery rollers 55, 56 and transported further in direction A. The drafting system 52 is configured as a 4 over 3 drafting system, that is to say it consists of three lower rollers I, II, III (I output lower roller, II middle lower roller, III input lower roller) and four upper rollers 57, 58, 59, 60. The diameters selected can be, for example, for the output lower roller I 40 mm, for the middle lower roller II 35 mm and for the input lower roller III 35 mm. The lower rollers I, II and III have spiral fluting. In the drafting system 50, the drafting of the fibre bundle, which consists of a plurality of fibre slivers 53, is carried out. The drafting operation is composed of the preliminary drafting operation and the main drafting operation. The roller pairs 60/III and 59/II form the preliminary drafting zone and the roller pairs 59/II and 58, 57/I form the main drafting zone. In the drafting system outlet 52, the drafted fibre silvers pass into a web guide means 61 and are drawn by means of the delivery rollers 34, 35 through a sliver funnel 62 in which they are combined to form a fibre sliver 63 which is then deposited (not shown) in cans or in the form of a can-less fibre sliver package. Reference letter A denotes the working direction. The exit speed of the fibre sliver 63 is 1200 m/min and more. The direction of rotation of the rollers is indicated by curved arrows. In FIGS. 3 and 4, the output lower roller, middle lower roller and input lower roller are indicated, in contrast to FIG. 5, by the reference numerals III, II and I, respectively, but those rollers are to be understood as having the corresponding general functions as the output lower roller I, middle lower roller II and input lower roller III of FIG. 5.

Figure 6:
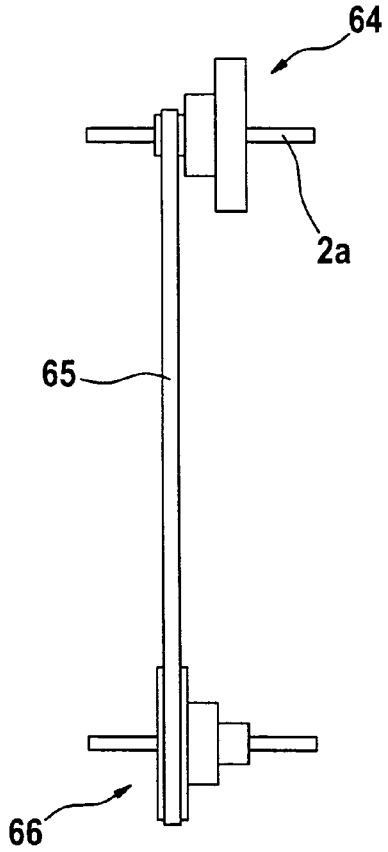
FIG. 6 shows a driving drive pulley of a second drive element and a driven drive pulley at the input of the gear configured as stepped pulleys.

FIG. 6 shows a further possible variation in the drive apparatus of, for example, FIG. 1*a*. A stepped pulley 64 is attached to the shaft journal 2*a*. The rotation of the stepped pulley 64 is transmitted by means of a flat belt 65 to a stepped pulley 66, which is mounted on the drive pulley 9 (see FIG. 1*a*) so as to rotate therewith. Different transmission ratios are implemented by relocation of the flat belt 65.

Different transmission ratios can also be implemented in the arrangement according to FIG. 1*a* by replacement of the drive pulley(s) 3 and/or 8 having the diameters given, for example by drive pulley(s) 3 and/or 8 having a different diameter or different numbers of teeth.

The gear 2*a* is a draft-altering gear. By changing the drive pulleys 3, 8, 9, 14 and/or 15, alterations in the rotational speed of the drafting system rollers II and III can be implemented.

The invention has been explained using the example of a drafting system 50 in which the drive of at least one first roller pair 60/III and/or 59/II is effected from one side by the first drive element 5; 2*a*, 3 and the drive of at least one other roller pair 57, 58/I is effected from the other side by the second drive element 6; 2*b*, 4. The invention includes in the same way a drafting system 52 in which the drive of the at least other roller pair 57, 58/I is effected from one side by the first drive element 5; 2*a*, 3 and the drive of the at least first roller pair 60/III and/or 59/II is effected from the other side by the second drive element 6; 2*b*, 4. The same applies to the drive of the calender rollers 34, 35 and of the coiler plate 45.

The drafting system 50 can draft a plurality of fibre slivers 53, for example in the case of a draw frame. The drafting system 50 can also draft only one fibre sliver, for example at the outlet of a carding machine (Integrated Draw Frame).

Illustrative of draw frames suitable for use with a device according to the invention are breaker frames. They are used in practice predominantly as preliminary draw frames, which are generally without levelling. Especially in the case of a preliminary draw frame without levelling, a relatively high degree of variability of drafting is not required by the customer and far exceeds the requirements. The customer will at this point, in accordance with his spin plan, generally have fixed doublings and drafts which are extremely rarely altered and any such alteration will be made exclusively by fixed amounts. The device according to the invention has a gear construction having a main transmission corresponding to the draft. The invention provides an optimum gearing solution with a drive means and a change-over point as main drafting transmission. As a result of the mechanical gear coupling of the draft to the motor control means, the requirements in terms of apparatus can be made substantially less. The entire gear is driven by one motor 1. The draft has been fixed mechanically by a main transmission step in the gear 10.

The device according to the invention allows transmitter-free, lower-precision drive control. This has the result in the mechanical motor construction that both sides of the motor 1 are provided with drive means and the gear 10 acquires an extremely simple form that makes optimum use of space. Such a construction, in particular, saves on at least one intermediate shaft joining the two drive sides. In addition, the overall belt guidance and belt tensioning has been extremely simplified.

Although the foregoing invention has been described in detail by way of illustration and example for purposes of understanding, it will be obvious that changes and modifications may be practised within the scope of the appended claims.

What is claimed is:

1. An apparatus on a drafting system of a spinning preparation machine with drafting system rollers forming drafting roller pairs, the apparatus comprising:

a drive motor and transmission devices for driving the drafting system rollers, wherein the drive motor has first and second rotating drive elements, and of wherein at least a first drafting roller pair is driven from one side by the first rotating drive element and of at least one further drafting roller pair is driven from an opposite side by the second drive element.

2. An apparatus according to claim 1, in which said first and second drive elements comprise outgoing shaft ends of the drive motor.

3. An apparatus according to claim 1, in which the first and second drive elements extend from opposite sides of the drive motor.

4. An apparatus according to claim 1, wherein at least one of said first and second drive elements is connected to a driven drafting roller of one of the first or second drafting roller pairs by the transmission devices comprising at least one gear arranged between the drive motor and said driven drafting roller.

5. An apparatus according to claim 4, in which the gear has a transmission step.

6. An apparatus according to claim 1, wherein the transmission devices comprise belts.

7. An apparatus according to claim 6, wherein at least one of the belts passes around at least two drive pulleys.

8. An apparatus according to claim 7, in which the drive pulleys are not all of equal diameter.

9. An apparatus according to claim 1, wherein the first drafting roller pair comprises an output roller pair.

10. An apparatus according to claim 9, wherein the at least one further drafting roller pair comprises input and middle roller pairs.

11. An apparatus according to claim 9, wherein a driving drive pulley of the first drive element has a larger diameter than a driven drive pulley for the output roller pair.

12. An apparatus according to claim 10, wherein the transmission devices comprise a gear between the second drive element and the input and middle roller pairs, and wherein a driving drive pulley of the second drive element has a smaller diameter than a driven drive pulley at an input of the gear.

13. An apparatus according to claim 12, in which the driving drive pulley at the output of the gear has a smaller diameter than driven drive pulleys for the input and middle roller pairs.

14. An apparatus according to claim 12, in which the driving drive pulley of the second drive element and the driven drive pulley at the input of the gear are constructed as stepped pulleys.

15. An apparatus according to claim 1, wherein the first drafting roller pair and the at least one further drafting roller pair define preliminary drafting and main drafting roller pairs.

16. An apparatus according to claim 1, in which the first drive element is arranged to drive one or more further components of the machine.

17. An apparatus according to claim 1, wherein at an output of the drafting system, a lower roller co-operates with two upper rollers.

18. An apparatus according to claim 10, an wherein the input roller pair of the drafting system has a driven drive pulley on one side and a driving drive pulley on the other side and the driving drive pulley is used for driving the middle roller pair of the drafting system.

19. An apparatus according to claim 10, in which the middle roller pair of the drafting system has a driven drive pulley on one side and a driving drive pulley on the other side and the driving drive pulley is used for driving the input roller pair of the drafting system.

20. An apparatus according to claim 1, having a belt for driving the input and middle roller pairs of the drafting system, further comprising at least one guide pulley and/or at least one tensioning pulley associated with the belt.

21. An apparatus on a drafting system of a spinning preparation machine with drafting system rollers forming drafting roller pairs, comprising:

a drive motor and transmission devices;

a first drive arrangement including a first rotating drive element at one side of the drive motor;

a second drive arrangement including a second rotating drive element at the other side of the drive motor; and wherein the first drive arrangement is arranged to drive at least a first roller pair and the second drive arrangement is arranged to drive at least one further roller pair.

22. The apparatus according to claim 21, wherein at least one of the first and second drive elements is coupled to a drafting roller of one of the drafting roller pairs by at least one gear and at least one belt arranged between the drive motor and the drafting roller.

* * * * *